US011325142B2

(12) United States Patent
Moran et al.

(10) Patent No.: US 11,325,142 B2
(45) Date of Patent: May 10, 2022

(54) WATER JET FOR A SHOWERHEAD

(71) Applicant: Greens Global Limited, Hamilton (NZ)

(72) Inventors: Ian Moran, Hamilton (NZ); Yonghua Tang, Hamilton (NZ)

(73) Assignee: GREENS GLOBAL LIMITED, Hamilton (NZ)

( * ) Notice: Subject to any disclaimer, the term of this patent is extended or adjusted under 35 U.S.C. 154(b) by 0 days.

(21) Appl. No.: 15/971,009

(22) Filed: May 4, 2018

(65) Prior Publication Data

US 2018/0318860 A1 Nov. 8, 2018

(51) Int. Cl.

| | |
|---|---|
| ***B05B 7/04*** | (2006.01) |
| ***B05B 1/16*** | (2006.01) |
| ***B05B 1/18*** | (2006.01) |
| *B05B 1/34* | (2006.01) |

(52) U.S. Cl.

CPC ..... *B05B 7/0425* (2013.01); *B05B 1/1681* (2013.01); *B05B 1/185* (2013.01); *B05B 1/169* (2013.01); *B05B 1/34* (2013.01)

(58) Field of Classification Search

CPC . B05B 7/0425; B05B 1/18–22; B05B 1/1681; B05B 1/185; B05B 1/169; B05B 1/34; E03C 1/084; E03C 1/08; E03C 1/086; E03C 1/0408

USPC ..... 239/428.5

See application file for complete search history.

(56) References Cited

U.S. PATENT DOCUMENTS

| | | | | |
|---|---|---|---|---|
| 4,738,398 A * | 4/1988 | Corsette | B05B 7/0425 239/427.3 |
| 6,267,305 B1 * | 7/2001 | Kondo | B05B 1/1618 239/428.5 |
| 6,270,022 B1 * | 8/2001 | Knapp | B05B 7/0425 239/428.5 |
| 2016/0325291 A1 * | 11/2016 | Zhou | B05B 1/18 |

* cited by examiner

*Primary Examiner* — Darren W Gorman
*Assistant Examiner* — Juan C Barrera
(74) *Attorney, Agent, or Firm* — Pilloff Passino & Cosenza LLP; Martin J. Cosenza

(57) ABSTRACT

The present invention provides a showerhead, and a water jet for a showerhead, that is specifically configured to aerate at least some of the water passing through the showerhead. This is achieved by a water jet configuration that may require less precision in manufacturing tolerances and may be a more cost-effective solution for producing a softer flow of water compared to prior art arrangements. The invention has particular application for handheld showerheads which have multiple spray arrays.

19 Claims, 3 Drawing Sheets

WATER JET FOR A SHOWERHEAD

CROSS REFERENCE TO RELATED APPLICATIONS

This application claims the benefit of New Zealand Patent Application No. 731614 filed May 5, 2017. The subject matter of this earlier filed application is incorporated herein by reference in its entirety.

FIELD

The invention generally relates to showerheads with customisable arrangements for distribution of water emitted from the showerhead. The invention has particular application to a water jet, and an array of water jets, for a handheld showerhead. However, it should be appreciated that the present invention may have application to a shower rose or other handheld arrangements for distributing a customisable spray of water.

BACKGROUND

There is an increasing trend in domestic plumbing installations towards use of handheld showerheads with customisable spray configurations. These allow the user, upon actuation of a switch, to adjust the flow pattern of a water stream emitted from the showerhead.

In many showerheads, this customisation is achieved through a series of water jets arranged around the face of the showerhead. When the switch is manipulated by the user, this actuates a valve (or valves as the case may be) which causes water to be directed to a specific array of water jets while preventing water flow to other arrays of water jets. Each array of water jets may be configured to achieve a specific spray pattern.

In this way, the user can select, for example, a fan-like spray pattern for broad coverage or a narrower spray pattern, which can have a soothing or massaging effect when directed at the skin.

Examples of such customisable showerheads are manufactured by the likes of Methven Limited (www.methven-.com/nz/home) or Hansgrohe International (www.hansgrohe-int.com). These are designed with multiple types of water jets, giving the user water flow options depending on their preference.

One of these options generates stream of water which is highly aerated, which manifests itself as a flow of foamy water. It has been found that this can be quite therapeutic for the user. This foamy water requires the introduction of air into the showerhead to create the flow of aerated water.

To achieve this aerated stream of water, the showerhead is configured with fine apertures surrounding each water jet. Fine internal ducting is provided between these apertures and the water jet. As a negative pressure is created within the water jet as water exits the showerhead, the apertures draw in air.

Directed via the internal ducting, this air is injected or otherwise introduced into the stream of water prior to being emitted from the water jet. This creates a stream of water that is relatively foamy and soft as it exits the showerhead.

However, it will be appreciated that the ducting and apertures are very fine and consequently they are prone to blockage. This is particularly true for water with a high calcium content. The calcium can build up over time and gradually block or impede passage of air through the apertures. This can then have a detrimental effect on the efficiency of customisable showerheads.

The apertures can also become blocked or have water flow impeded when the showerhead is used in plumbing installations that are newly installed and have yet to be flushed through or lack filters on the water supply (such as bores or the like).

Furthermore, particularly high manufacturing tolerances and engineering are required to achieve the necessary ducting. This can impact on the overall cost of the handheld showerhead.

SUMMARY

Certain embodiments of the present invention may provide solutions to the problems and needs in the art that have not yet been fully identified, appreciated, or solved by current showerheads. It is an object of the present invention to address the foregoing problems with the prior art, or at the very least, to provide the public with a useful choice.

According to one aspect of the present invention there is provided a water jet for a showerhead, the water jet including: a water passage; an air passage; an outlet; a first conduit linking the water passage to the air passage; a second conduit linking the air passage to the outlet, wherein the first conduit tapers outwardly along a portion of its length, and the second conduit tapers inwardly along a portion of its length.

According to one aspect of the present invention there is provided a showerhead, the showerhead including a plurality of water jets, wherein at least one water jet includes: a water passage; an air passage; an outlet; a first conduit linking the water passage to the air passage; a second conduit linking the air passage to the outlet, wherein the first conduit tapers outwardly along a portion of its length, and the second conduit tapers inwardly along a portion of its length.

The present invention provides a showerhead, and a water jet for a showerhead, that is specifically configured to aerate at least some of the water passing through the showerhead. This is achieved by a water jet configuration that may require less precision in manufacturing tolerances and may be a more cost-effective solution for producing a softer flow of water compared to prior art arrangements.

BRIEF DESCRIPTION OF DRAWINGS

In order that the advantages of certain embodiments of the invention will be readily understood, a more particularly description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
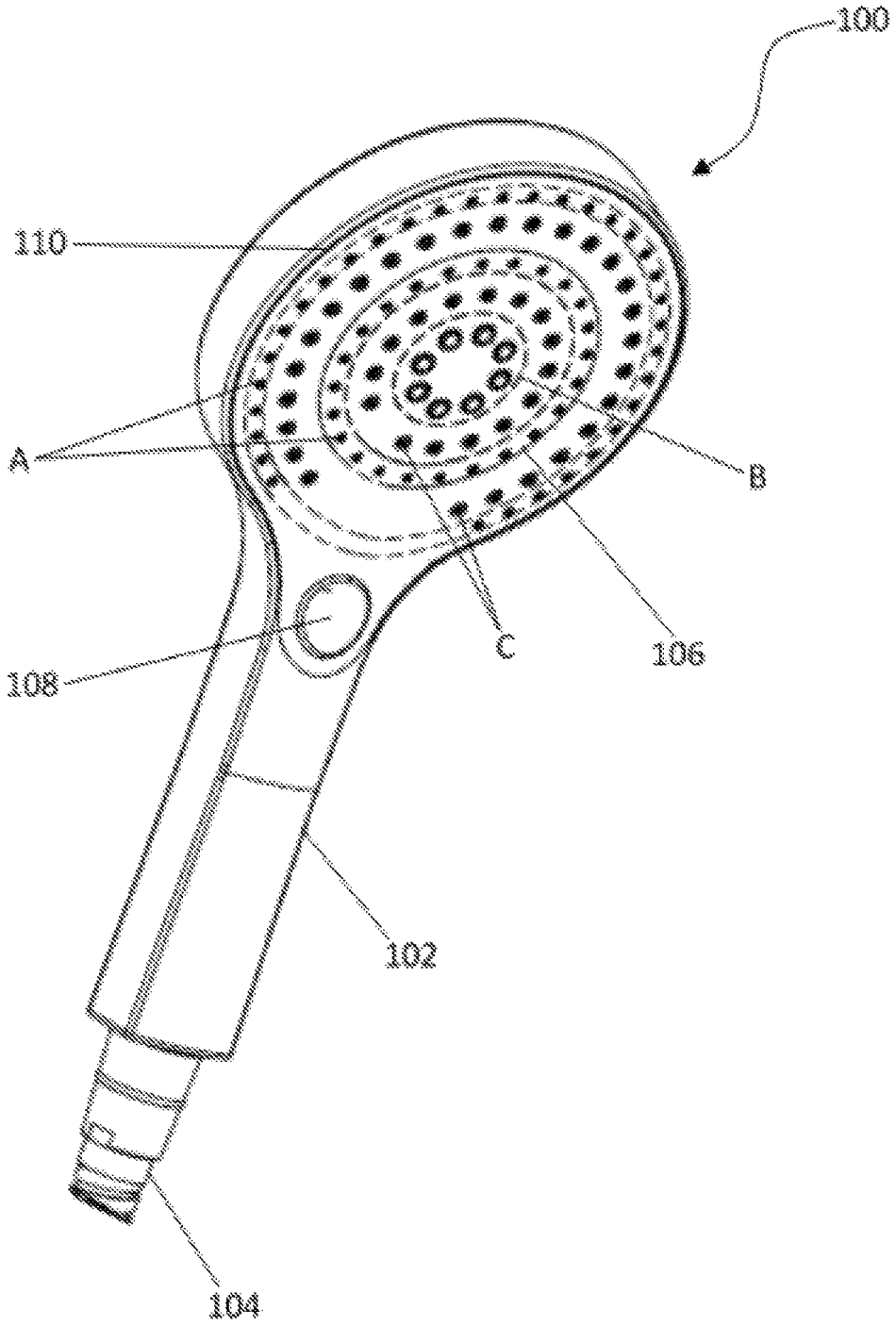
FIG. 1 is a perspective view of an exemplary embodiment of the present invention as used in a handheld showerhead.

Reference shall now be made throughout the remainder of the present specification to the invention being used with a handheld showerhead. Such showerheads typically are mounted to shower slides and include a handle by which a user may hold the showerhead.

However, the use with a handheld showerhead is not meant to be limiting and the present invention may be used with conventional fixed showerheads (often referred to as a shower rose) or other arrangements in which an aerated flow of water is desired.

A water jet should be understood to be an outlet and its related internal architecture through which water exits the showerhead.

Although reference is made to the invention as being a water jet in a singular form, it should be understood that, when used in a showerhead, there will be a plurality of water jets in an array which represents the desired water spray pattern. Furthermore, some parts of the water jet may be communal structures as will become apparent from the following discussion of the invention.

In exemplary embodiments of the present invention, the showerhead may include two or more arrays of water jets.

Each array may be arranged for a specific purpose; for example, the first array may be for a standard spray pattern, appropriate for everyday use. The second array may be arranged to deliver highly aerated water.

In some showerheads, a third (or more) array may be provided. For example, a third array to provide a pulsating, relatively focused, stream of water for a massage effect. Persons skilled in the art will appreciate other variations in arrays may be achieved.

Furthermore, it should be appreciated that the water jet of the present invention may not be employed in all the arrays of the showerhead. As noted above, the water jet that is the subject of the present application is specifically configured to aerate at least some of the water passing through the showerhead, and thus is particularly suitable for delivering highly aerated water.

The water jet of the present invention includes a water passage.

This should be understood to be linked to a supply of water. That water supply may be regulated by valves or such like to control the water pressure, and therefore the amount of water, flowing through the showerhead.

In exemplary embodiments of the present invention, the valves may be actuated by the user using a switch or the like to direct water to a specific array of water jets. Means to achieve this will be readily be apparent to a person skilled in the art.

The water passage includes a top side and a bottom side. The first conduit opens from the bottom side of the water passage.

The water jet of the present invention includes an air passage. This air passage should be understood to be linked to the environment via internal ducting leading to apertures positioned about the showerhead.

The air passage includes a top side and a bottom side. The first conduit ends in the top side of the air passage while the second conduit opens from the bottom side of the air passage.

In exemplary embodiments of the present invention, the apertures of the air passage open about the perimeter of the showerhead. However, this is not meant to be limiting and it is possible that the apertures may open out upon the reverse side of the showerhead to its face.

It should be appreciated that as water flow passes through the water jet, negative pressure is formed as it passes through the air passage. This draws in air from the environment to the showerhead via the ducting, and ultimately this air is entrained in the water flowing through the air passage and out the outlet.

In exemplary embodiments of the present invention, the water and air passages are configured as air and water chambers, with a plurality of first and second conduits. It will be understood that this means that the first and second conduits are linked to common air and water chambers. This is preferable for ease of manufacture as it means that a single water passage and single air passage may serve a number of first and second conduits together with outlets.

While it will be understood that although the showerhead may have common air and water passages formed as chambers within the showerhead, there will be a plurality of pairs of first and second conduits, each pair having its own outlet.

The first conduit and second conduits allow water to be conducted through the water jet to the outlet of the showerhead.

In exemplary embodiments of the present invention, in a plan view, the centre of the first and second conduits are substantially in line with each other. The first conduit links a water passage to the air passage.

In exemplary embodiments of the present invention, the first conduit includes a first untapered section, i.e. a section where the cross-sectional area is constant; and a second section which is outwardly tapered. This latter section should be understood to progressively widen from adjacent the first section, which begins at the bottom side of the water passage, to the top side of the air passage, into which the first conduit opens.

In exemplary embodiments of the present invention, the angle of tapering of the outwardly tapered section is 10°. However, this is not meant to be limiting and the degree of taper could be less or more depending on the requirements of the user.

However, there may be some limitations on the extent of the degree of taper. If the degree is too extensive, this can lead to water backing up the air chamber as its flow rate may be adversely affected. Conversely, if there is only minimal taper, the resulting water jet as it is emitted from the showerhead may be insufficiently aerated and too harsh for the user.

The second conduit links the air passage to the outlet.

In exemplary embodiments of the present invention, the second conduit includes a plurality of tapered sections, each section separated from its adjacent via a shoulder or step.

These shoulders are useful in that they provide an impact surface for water as it flows through the second conduit. The impact surface helps with agitating the water, encouraging entrainment of the air that has been introduced into the water stream. However, in alternative embodiments, the second conduit has a consistent or curved taper, with no distinct shoulders.

In exemplary embodiments of the present invention, the second conduit includes three tapered sections. The first section begins at the bottom side of the air passage and tapers inwardly to the first shoulder defining the transition between the first and second sections of the second conduit.

In exemplary embodiments of the present invention, the angle of tapering of the second conduit is 10°. However, as with the first conduit, this is not meant to be limiting and the degree of tapering could be less or more depending on the requirements of the user.

Although reference is made above to the second conduit having three tapered sections, this is not meant to be limiting. In some embodiments, there may be two tapered sections, and in some of these embodiments, there may be an untapered section interposed between the two tapered sections.

In other embodiments, the second conduit may be provided with four tapered sections. It will be appreciated that the number of sections may depend on the extent of aeration that is desired.

In exemplary embodiments of the present invention, the third section of the second conduit terminates in the outlet of the water jet.

The outlet should be understood to be the aperture by which water exits the showerhead. The outlet may be of a relatively simple configuration with no special tapering or such like. However, in some embodiments of the present invention, the outlet may be specially configured to enhance the aeration of the water as it exits.

For example, in some embodiments, the outlet may be configured with a bar or the like which spans its width. This partially occludes the outlet, disrupting the flow of water as it exits.

In other embodiments, the outlets may be configured as elongate nozzles, and direct the water as it exits in a specific direction. This may enhance the distribution of the water as it is emitted from the showerhead.

Some embodiments of the present invention has a number of advantages over prior art arrangements including, but not limited to, being effective to manufacture due to lower engineering tolerances required to achieve the internal ducting; may be more cost effective for consumers to purchase; provides an alternative arrangement for producing an aerated flow of water; less prone to blockage through build-up of calcium or fine particles within the showerhead, particularly in plumbing installations that were either not flushed after being fitted or lack filters on the water supply.

FIG. 1 illustrates one embodiment of the present invention, (generally indicated by arrow 100) as part of a handheld showerhead.

The showerhead (100) includes a handle (102), by which the user may articulate the showerhead (100), along with a hose (104) through which water enters the showerhead. The flow of water through the hose is controlled using a shower mixer (not shown).

The showerhead (100) has a face (106) and a back (not visible in this view) opposing the face. The face is provided with a plurality of outlets, which are arranged in specific arrays (A, B, C). These arrays achieve three distinct spray patterns. However, in some alternative embodiments, not shown here, the outlets of the showerhead may be arranged in arrays such that there are only two distinct spray patterns; the first is that of a regular showerhead and the second provides highly aerated water. It has been found that water with a high degree of aeration can have a therapeutic effect on the skin of the user.

In the embodiment of FIG. 1, the first spray pattern is that of a regular showerhead and is defined by array A and is relatively wide with the outlets spread across the face. This array is defined by an outer semi-circular array and more central circular array.

The second array, B, is relatively focused and compact with the outlets clustered together at the centre of the face. This array has a narrow spray pattern which provides a pulsating effect on the skin of the user, similar to being lightly massaged.

The third array (C), through the use of specifically configured water jets, is intended to deliver highly aerated water which, as noted above, can have a therapeutic effect on the skin of the user. There is an outer semi-circular array, positioned between the outer and central arrays A, and a more central circular array, positioned between the central array of A and array B.

Water flow between arrays (A, B, C) may be varied by using the button (108) on the handle (102) which is operable by the user. Internally, this button operates a valve (not shown) which directs water flow to specific arrays of water jets.

About the perimeter (110) of the face (106) of the showerhead (100) are provided a series of air inlets (not visible). As water flows internally within the showerhead and is emitted through the outlets, a negative pressure is created. This draws environmental air into the showerhead and, via its internal architecture (not visible), this is directed into the water flow destined for array B, substantially aerating it.

Figure 2:
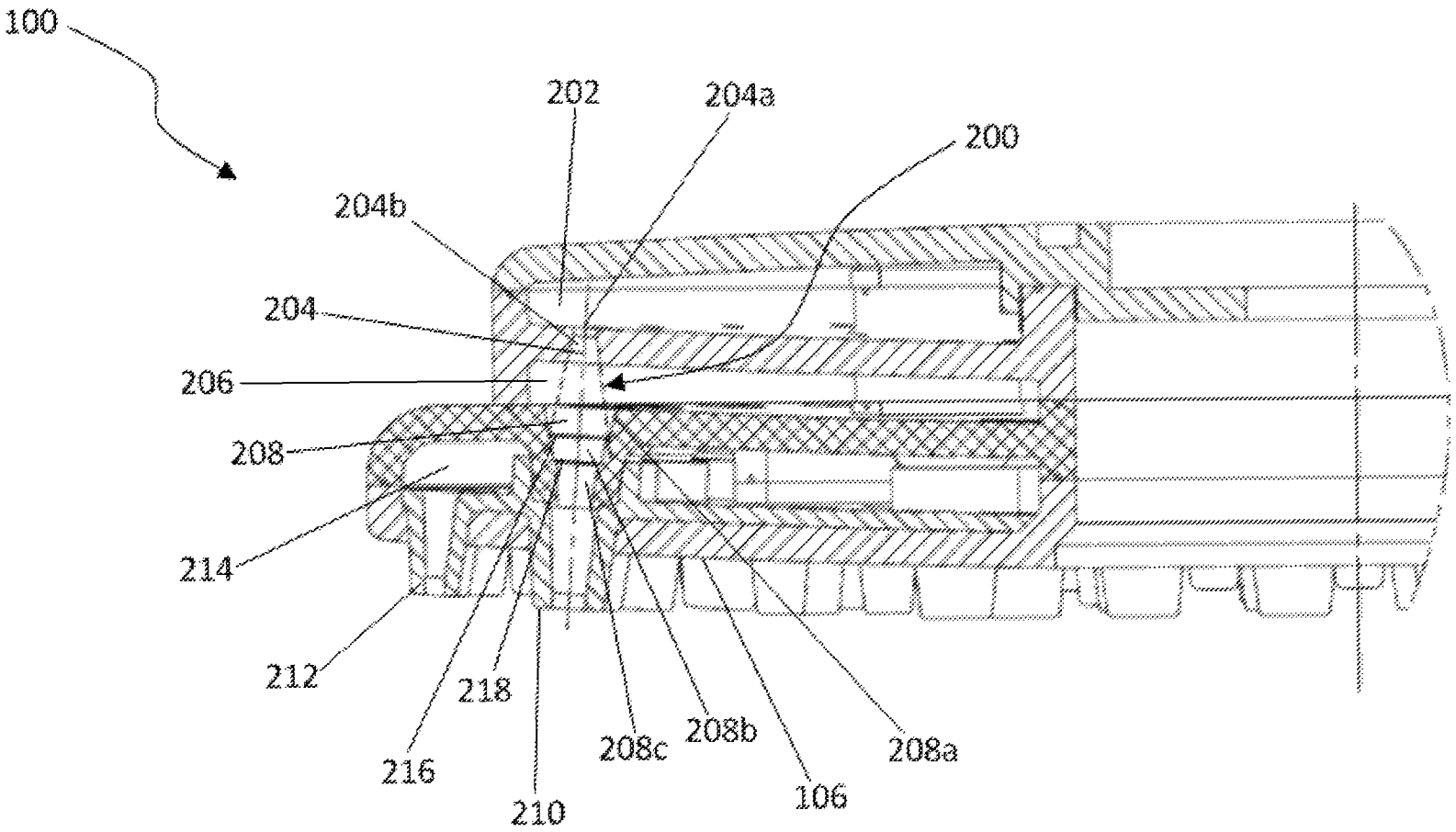
FIG. 2 is a cross sectional view of an exemplary embodiment of the present invention.

Turning now to FIG. 2, this depicts a cross sectional view of the showerhead (100) illustrated in FIG. 1 and allows its internal architecture to be easily seen. In particular, the cross-section of a water jet (200) that forms part of array C is shown.

The main components of the water jet (200), from top to bottom, the bottom being the face (106) of the showerhead (100), are a water chamber (202), the first conduit (204), an air chamber (206), and the second conduit (208) leading to the outlet (210).

Also visible is this view is an outlet (212) that is part of array A (not shown) and this has its own water chamber (214) is communicative with other outlets of that array.

Turning back to the water jet (200) of interest, its water chamber (202) is linked and otherwise connected at its far end (not shown) to the supply of water (not shown).

In order to exit the showerhead (100), the water must enter the first conduit (204). The first conduit includes an initial non-tapered section (204*a*); this provides a sharp transition from the water chamber into the conduit. The result is that the water becomes more turbulent as it enters the first conduit and flows towards the air chamber.

The first conduit (204) then transitions to an outwardly tapered section (204*b*), which in the illustrated example, is 10° away from the vertical. This helps to create a cavitation effect upon the water as it flows down the side of the first conduit.

The first conduit (204) links the water chamber (202) to the air chamber (206). At the air chamber, air is drawn into the flow of water (not visible). This is achieved through the air chamber being linked to apertures (not visible) which are arranged around the perimeter of the showerhead (100). As the water moves through the air chamber, it creates a vacuum, thus drawing in air from the external environment into the air chamber. This air then becomes entrained in the water passing through the air chamber.

Water (not visible) exits the air chamber (206) via the second conduit (208). It will be noted that the second conduit is substantially inline with the first conduit (204).

As can be seen, this tapers progressively, in sections (208*a*, 208*b*, 208*c*), towards the outlet (210). The first (208*a*) and second sections (208*b*) of the second conduit form a shoulder (216) as it transitions from one section to the next. A further shoulder (218) demarcates the transition between the second section (208*b*) and the third section (208*c*).

The first (208*a*) of these sections is located and dimensioned such that water cascading down the sides of the first conduit (204) and through the air chamber (206) impacts on the shoulder (216). This flow path is indicated by dashed lines. This agitates the flow of water further entraining the air drawn into the water flow from the air chamber into the flowing water.

As the water (not visible) exits the showerhead (100), via the outlet (210), it has become highly aerated and is consequently relatively foamy due to the presence of entrained air as bubbles. This provides a softer stream of water, which may be more therapeutic on the skin of the user. As can be seen, the outlet is substantially inline with the first conduit (204) and second conduit (208).

Figure 3:
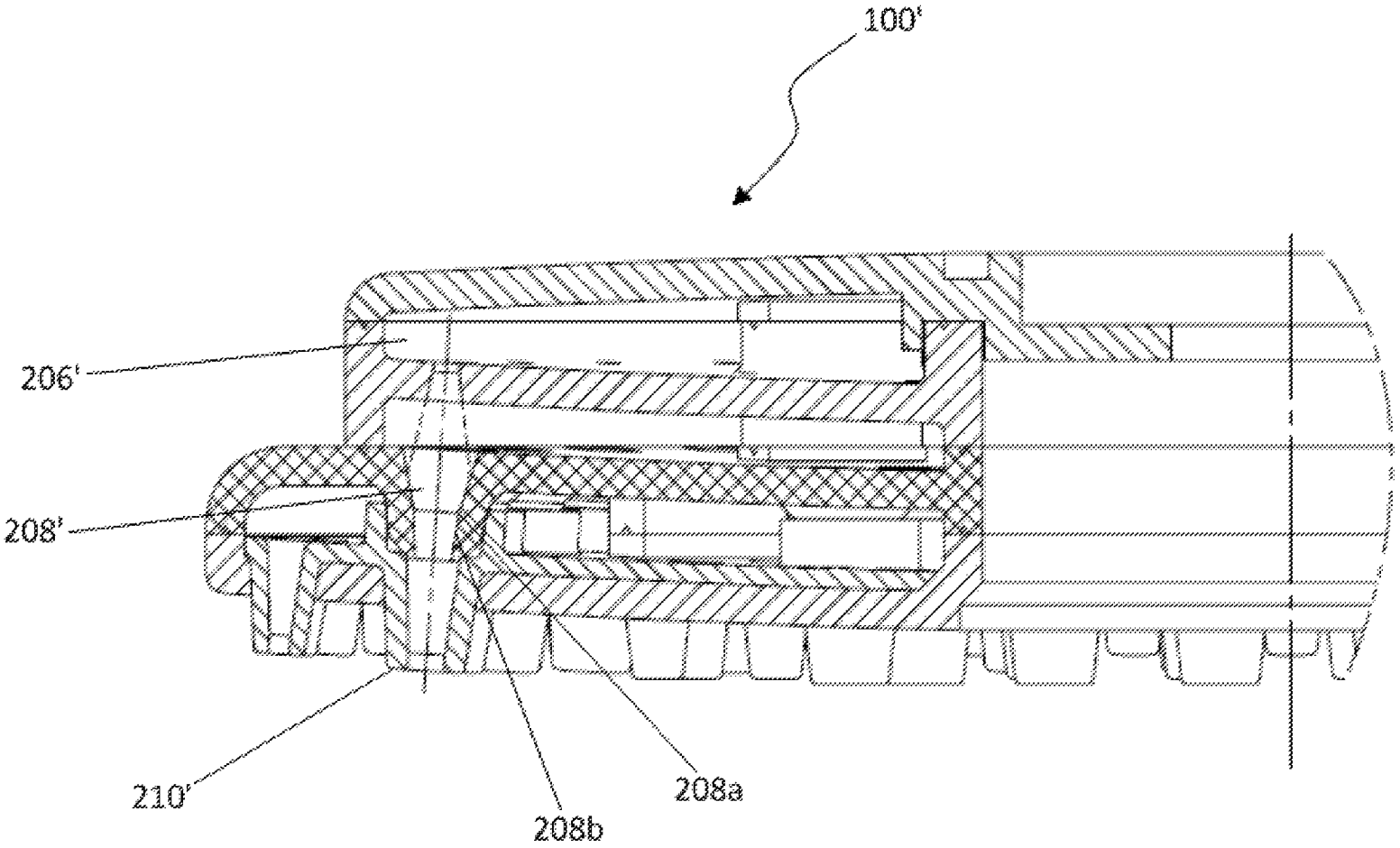
FIG. 3 is a cross sectional view of an alternative embodiment of the present invention.

FIG. 3 depicts a cross sectional view of an alternative embodiment of the showerhead (100'). In most respects, the illustrated embodiment is similar to that of FIG. 2. However, the internal architecture of the second conduit (208') differs somewhat. Instead of having three distinct sections to the second conduit, there is only two sections (208*a*', 208*b*').

Both of these sections (208*a*', 208*b*') have an inward taper, with the first being greater relative to the second. In contrast to the embodiment of FIG. 2, in which the impact point of the water cascading through the second conduit (208) is substantially on the shoulder (216), it should be noted that the impact of the stream of water (indicated by the dashed lines) is substantially within the first section (208*a*').

This arrangement may help in ensuring the cascade of water is directed towards the outlet (210') with minimal backing up into the air chamber (206').

All references, including any patents or patent applications that may be cited in this specification are hereby incorporated by reference. No admission is made that any such reference constitutes prior art. The discussion of the references states what their authors assert, and the applicants reserve the right to challenge the accuracy and pertinency of the cited documents. It will be clearly understood that although a number of prior art publications may be referred to herein, this reference does not constitute an admission that any of these documents form part of the common general knowledge in the art in New Zealand or in any other country.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "preferred embodiments" or "exemplary embodiments", or similar language means that a particular feature, structure, or characteristic described in connection with the embodiment is included in at least one embodiment of the present invention. Thus, appearances of the phrases "in preferred embodiments" or "in exemplary embodiments", or similar language throughout this specification do not necessarily all refer to the same group of embodiments and the described features, structures, or characteristics may be combined in any suitable manner on one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A water jet for a showerhead for producing aerated foamy water, the water jet including: a water passage; an air passage; an outlet for the aerated foamy water; a first conduit linking the water passage to the air passage, wherein the first conduit has a central vertical axis; a second conduit linking the air passage to the outlet, wherein the second conduit has a central vertical axis that is substantially in line with the central vertical axis of the first conduit, wherein the first conduit tapers outwardly from its central vertical axis along a portion of its length in a downstream direction and defines a flow path for water passing therethrough, and the second conduit tapers inwardly towards its central vertical axis along a portion of its length in a downstream direction, and wherein the second conduit includes a first section and a second section, wherein the first section has a reduced inward taper relative to the second section and includes an impact area for water travelling along the flow path.

2. The water jet as claimed in claim 1, wherein the water passage includes a top side and a bottom side, wherein the first conduit opens from the bottom side.

3. The water jet as claimed in claim 1, wherein the air passage includes a top side and a bottom side, wherein the first conduit opens into the top side and the second conduit opens from the bottom side.

4. The water jet as claimed in claim 1, wherein the first conduit includes a first untapered section and a second outwardly tapered section.

5. The water jet as claimed in claim 4, wherein the second outwardly tapered section is angled outwards at 10° from the central vertical axis.

6. The water jet as claimed in claim 1, wherein the first section is separated from the second section via a shoulder.

7. The water jet as claimed in claim 6, wherein the second conduit includes a third tapered section.

8. The water jet as claimed in claim 6, wherein the second conduit has at least one section tapering inward at an angle of 10° from the central vertical axis.

9. The water jet as claimed in claim 1, wherein the water jet is for producing aerated foamy water.

10. A showerhead for producing aerated foamy water, wherein the showerhead includes a plurality of outlets defining a first array and a second array, and wherein the second array includes a plurality of water jets, wherein at least one water jet includes: a water passage; an air passage; an outlet for the aerated foamy water; a first conduit linking the water passage to the air passage, wherein the first conduit has a central vertical axis; a second conduit linking the air passage to the outlet, wherein the second conduit has a central vertical axis that is substantially in line with the central vertical axis of the first conduit, wherein the first conduit tapers outwardly from its central vertical axis along a portion of its length in a downstream direction and defines a flow path for water passing therethrough, and the second conduit tapers inwardly towards its central vertical axis along a portion of its length in a downstream direction, and wherein the second conduit includes a first section and a second section, wherein the first section has a reduced inward taper relative to the second section and includes an impact area for water travelling along the flow path.

11. The showerhead as claimed in claim 10, wherein the showerhead includes a handle.

12. The showerhead as claimed in claim 10, wherein the first array and the second array is communicative with a supply of water, wherein the supply of water is at least partially regulated by a switch on the handle.

13. The showerhead as claimed in claim 10, wherein the water passage is communicative with the plurality of water jets.

14. The showerhead as claimed in claim 10, wherein the air passage is communicative with the plurality of water jets.

15. The showerhead as claimed in claim 10, wherein the air passage includes internal ducting to one or more apertures positioned about an exterior surface of the showerhead.

16. The water jet as claimed in claim 10, wherein the waterjet is configured so that water exiting the outlet is already aerated, and wherein there are a plurality of second outlets in addition to the outlet, arrayed adjacent the outlet.

17. The showerhead of claim 10, wherein the showerhead includes a handle, and wherein the first array and the second array are arrayed about an axis and an outlet of the first array and/or the second array establish a distalmost component of a spray outlet area of the showerhead relative to direction along the axis.

18. The showerhead of claim 10, wherein the showerhead is configured to aerate water prior to leaving the outlet, and wherein there are a plurality of second outlets in addition to the outlet, arrayed adjacent the outlet.

19. The showerhead as claimed in claim 10, wherein the first array is configured to deliver a spray pattern, which spray pattern is different from the delivery of water that is delivered by the second array.

* * * * *